United States Patent [19]

Emerson

[11] 4,080,714

[45] Mar. 28, 1978

[54] FLEXIBLE POLISHING DRUM SEGMENT AND METHOD OF MAKING AND MOUNTING SAME

[75] Inventor: Grahame W. Emerson, Culver City, Calif.

[73] Assignee: Merit Abrasive Products, Inc., Compton, Calif.

[21] Appl. No.: 658,840

[22] Filed: Feb. 17, 1976

[51] Int. Cl.[2] ..... B21D 39/00; B23P 11/02

[52] U.S. Cl. ..... 29/509; 29/515; 29/525; 51/334

[58] Field of Search ..... 29/509, 525, 515; 51/334, 337, 407, 328, 399

[56] References Cited

U.S. PATENT DOCUMENTS

| | | | |
|---|---|---|---|
| 3,058,269 | 10/1962 | Block | 51/337 |
| 3,619,948 | 11/1971 | Burns | 51/334 X |
| 3,648,417 | 3/1972 | Block | 51/334 |
| 3,653,856 | 4/1972 | Field | 51/334 |
| 3,711,261 | 1/1973 | Burns | 51/334 |

*Primary Examiner*—Charlie T. Moon
*Attorney, Agent, or Firm*—Ellsworth R. Roston

[57] ABSTRACT

A flexible polishing drum segment for use with a polishing or grinding hub. The segment comprises a plurality of abrasive flaps of uniform size and shape, joined together along a common edge to a metal strip. The metal strip comprises first and second, substantially flat plate sections extending parallel to one another in surface-to-surface abutment. One of the plate sections is longer than the other and it is to this longer plate section that the packet is joined. The first and second plate section are integral with and joined together by a root element which is generally circular in configuration. A core is located within the root element to substantially fill the entire volume thereof.

15 Claims, 5 Drawing Figures

FLEXIBLE POLISHING DRUM SEGMENT AND METHOD OF MAKING AND MOUNTING SAME

BACKGROUND OF THE INVENTION

There are many applications for polishing or very light grinding devices, particularly in the dressing and polishing of internal bores of pipes, etc. In the past, one type of device which has been employed comprised a generally circular hub mounted upon a rotatable arbor in order to drive the hub about its axis. The hub has been provided with lingitudinal slots which extend between the opposite end faces of the hub and open on the periphery thereof. From the periphery, the slots extend, and terminate at, a generally circular bore which also extends between the opposite end faces of the hub. Each slot-bore combination is so configured as to receive and hold a segment in such a manner that the segment is retained in the hub, particularly against centrifugal force generated by the hub's rotation.

In general, the prior art drum segments have comprised a plurality of abrasive flaps of uniform size and shape, joined together along a common edge to form a packet. The packet is fastened to a metal strip comprising a pair of plates or plate sections, one of which is longer than the other. The longer plate or plate section is overlapped with the common edge of the packet so that the two may be joined, for example, by stapling.

The two plate sections of the metal strip are flat, generally parallel to one another, and located in surface-to-surface abutment. They are joined together by a root element which is generally circular in shape. The root element is so configured as to fit within the bore of the hub and the plates fit within the adjoining slot in the hub. The length of the shorter plate has generally been approximately equal to the radial dimension of the slot in the hub to provide full support for the segment in the hub with as little play as possible, thereby minimizing wear, etc.

In general, the circular root element has been employed to firmly fix the segment to the hub and prevent the segment from being pulled radially from the hub by centrifugal force. Although this principle of construction is sound, it has not been totally satisfactory; the high tensile or bending forces exerted on the root element by the segment during polishing operations have caused the root element to flatten out or assume a somewhat tear drop shape. This allows the segments to become misaligned and either so loose within the hub as to be unstable, when the hub is stopped, or to bind within the hub so that they are difficult, at best, to remove.

Further, it has been determined that the formation of the root element causes the junction of the element with each of the plate sections to occur at relatively sharp bends, i.e., angles approaching 90°. It has been determined that these sharp bends lend themselves quite readily to fracture in use, particularly in the plate section to which the packet is joined. Thus, the packet may become misaligned with the hub, at best, and may even pull away from the hub entirely under centrifugal force.

Accordingly, it has become necessary to devise an economical method of overcoming these deformation and fracturing problems in order to allow continued use of these very valuable tools.

SUMMARY OF THE INVENTION

The present invention provides a surprisingly simple and economical solution to these problems in a manner which allows the device to be greatly strengthened and the problems to be substantially completely overcome.

Briefly, the solution to the prior art problems comprises the formation of a root element in the form of a substantially solid body joining the two plate sections. More specifically, it has been found that the solution may be embodied in the provision of a solid core element located within and substantially filling the volume of the root element. The provision of a core element within the root at the time of formation of the latter causes the bends at the junctions of the root element and the plate sections to be less sharp, i.e., at smaller angles. In other words, crimping at the junction is not so tight as to allow the metal to fracture and the break, or change in direction of the metal, is enlarged and made into a much smoother transition.

Further, the provision of the core element totally eliminates any possibility of deformation of the root element since the solidity of the core positively prevents the root element from becoming misshapen because of the inability of the root element to adjust its interior volume.

Those skilled in the art, upon perusal of the following detailed description and accompanying drawing, will quickly understand these and additional objects of the invention. Also, additional embodiments of the invention, as defined in the appended claims, will readily become apparent.

DETAILED DESCRIPTION

Figure 5:
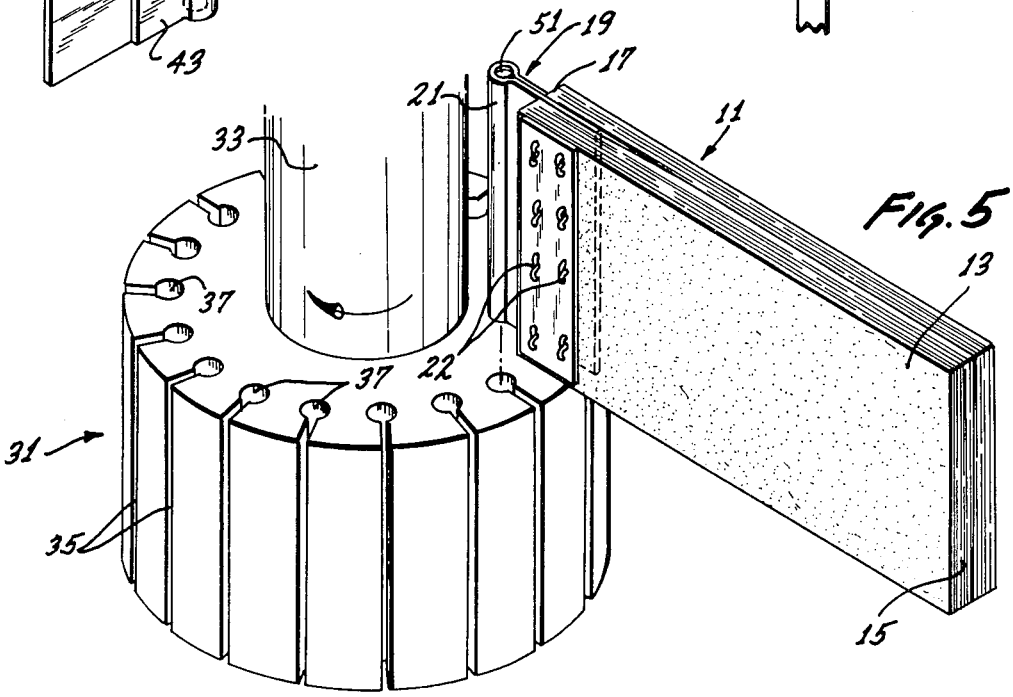
FIG. 5 comprises an isometric illustration of a flexible drum segment formed in accordance with the present invention, together with a rotatable hub with which the segment may be employed.

Referring first to FIG. 5, there is shown a flexible drum segment 11 comprising a packet 13 formed from individual abrasive flaps 15 of substantially uniform size and shape. Each flap has an abrasive surface and the flaps are arranged so that all of the abrasive surfaces face in the same direction in order that a work product surface may be polished by movement of the packet across the surface. Such movement is generated by rotation of the shaft 33 in the direction illustrated by the arrow.

As illustrated, the flaps are joined together along a common edge 17 and joined to a root member 19 by any suitable means, such as by staples 22. As illustrated there, the root member 19 extends into, or overlaps, with the packet at the common edge of the flaps in order to allow the two to be joined together. The root member 19 terminates, at its inner end, in a root element 21 which is generally circular in configuration.

In use, the packet may be employed with a hub 31 mounted on a rotatable arbor 33. The hub 31 may be provided with a series of longitudinal slots 35 which extend between the opposite faces or ends of the hub and open on the periphery thereof. Each slot terminates within the hub in a circular opening or bore 37 and, as is apparent from FIG. 5, the root element 21 fits within a bore 37 and the portion of the root member 19 extending to the packet 13 will fit within the related slot 35. Thus, when the arbor 33 is turned, each flexible drum segment 11 mounted on the hub will turn with it and polishing can be accomplished.

Figure 1:
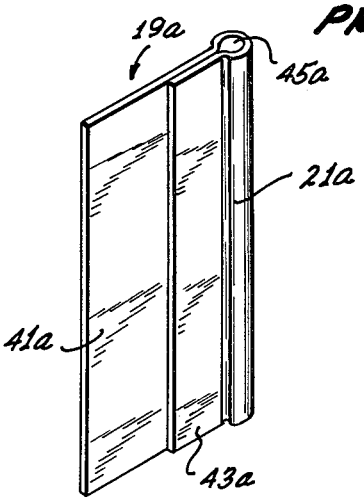
FIG. 1 PRIOR ART
FIG. 1 comprises an isometric illustration of a root member formed in accordance with the prior art.
Figure 2:
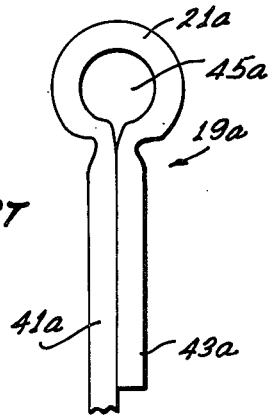
FIG. 2 PRIOR ART
FIG. 2 comprises an end view of the prior art root member shown in FIG. 1.

Referring now to FIGS. 1 and 2, there has been shown a root member 19*a* comprising a first plate or plate section 41*a* and second plate or plate section 43*a*. The plates are integral with and joined together by a circular root element 21*a* having a hollow central portion 45*a*.

As seen particularly well in FIG. 2, in these prior art devices, the plates 31*a* and 43*a* are joined to the root element 21*a* by relatively sharp bends in the plate material. In fact, the angles between the plates and the root element approach 90°. As stated previously, with these prior art devices it has been found that the root elements tend to deform from a circular shape into an oval or tear drop shape in use. This deformation is due both to the centrifugal force generated by rotation of the hub and to the tensile or bending forces generated by friction of the packets with the surface being polished. Consequently, the deformed structure has caused the segments to be either jammed into the hub or so loosened as to be misaligned and/or inadvertently removed from the hub.

Further, the sharp bends between the root element and the plates have fractured in many cases as a result of the same force described previously. Normally, the fractures occur at the junction of the plate 41*a* with the root element 21*a* since it is the plate 41*a* which transmits nearly all of the forces from the packet to the root element.

As can be seen from the Figures, the plates 41*a* and 43*a* have been formed to be substantially parallel to one another and in surface-to-surface abutment so that the two plates will fit closely within the slot 35 of the hub and prevent play or chatter therein. The plate 41*a* is relatively longer, in radial dimension relative to the hub, than is the plate 43*a* and it is this former plate which is overlapped with the packet so that the root member and the packet may be joined. Plate 43*a*, on the other hand, does not overlap with the packet but may extend into contact with the common edge thereof in order to both facilitate the positioning of the packet and the root member relative to one another and to provide greater strength to the root element in production and use.

Figure 3:
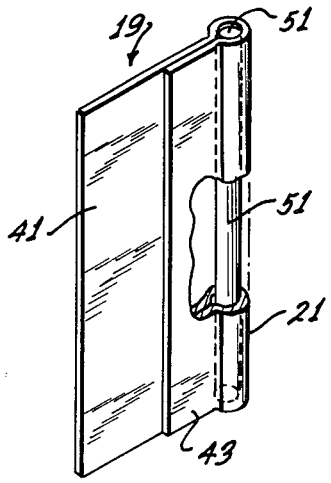
FIGS. 3 and 4 comprise a partially broken away isometric view and an end view, respectively, of a root member formed in accordance with the present invention.
Figure 4:
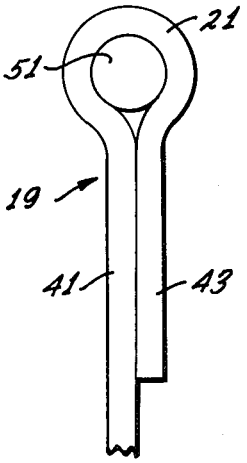

Referring now to FIGS. 3 and 4, it can be seen that those portions of the device which are similar to the prior art device have been provided with identical identification numerals, with the letter portion of the identifier eliminated. Consequently, no repetition of description of those structures is necessary.

In accordance with the present invention, when a root member 19 is being formed, a rod-like core 51 is inserted within the root element 21 substantially on the axis of the root element. Preferably, the length of core 51 is substantially equal to the height of the root element and plate sections. Then the plate sections may be bent about the core 51 and the illustrated root member is produced. As illustrated, the axis of the root element is generally perpendicular to the top and bottom of the plate from which the root member 19 is formed. Thus, the core will be tightly gripped within the root element 21 and will substantially fill the volume therein.

It has been found that the core 51 completely eliminates the possibility of deformation of the root element 21 since, as a solid member, it eliminates any volume into which the root element could possibly deform or be moved under the influence of the tensile and centrifugal forces. Further, the core 51 provides the significant benefit of smoothing out or eliminating the sharpness of the bends between the plates 41 and 43 and the root element 21, as illustrated in FIG. 4. Surprisingly, this alteration of the shape of the bends, i.e., the reduction in the angles between the plates and root element, has totally eliminated the tendency of the plate 41 to break at the junction. It is believed that this results from the fact that the plate is not subjected to such severely localized working forces during manufacture and the forces transmitted during use do not undergo such rapid change in direction in the metal. Consequently, it has been found that the use of the core 51 within the root element substantially eliminates all of the prior art problems and transforms a substantially unacceptable tool into a very dependable and economical product.

As stated previously, those skilled in the art, having now reviewed the description of the presently preferred embodiment, will readily be able to devise further embodiments of the invention which will now be defined in the claims.

I claim:

1. A flexible drum segment comprising
an abrasive packet including
a plurality of flaps of substantially identical size and shape joined together along one common edge thereof,
a root member comprising
a first, relatively long plate section,
means for fixing said packet to said first plate section,
a second, relatively short plate section extending parallel to and in surface-to-surface abutment with said first plate section, and
a root element integral with and extending between said first and second plate sections in a progressively sloping relationship, having no sharp bends, in successive positions on the root element and in the transition between the root element and the first and second plate sections, and
core means located within and substantially filling said root element.

2. The flexible drum segment of claim 1 wherein said core means comprises
a solid rod member extending along substantially the entire length of said root element.

3. The flexible drum segment of claim 1 wherein
said packet overlaps said first plate section but does not overlap said second plate section.

4. A flexible drum segment of claim 3 wherein
said fixing means comprises staple means passed through and gripping said packet and said first plate means.

5. A flexible drum segment for use in a polishing tool comprising
a root member including
a root element of generally circular, hollow configuration,
a first plate means integral with and extending from said root element in a relationship having small angles between successive positions in the transition between the root element and the first plate means and having a uniform height equal to the height of said root element and a first length extending outwardly from said root element, and a second plate means integral with and extending from said root element in substantially parallel relationship to, and in surface-to-surface abutment with, said first plate means in a relationship having small angles between successive positions in the transition between the root element and the second plate means and having a uniform height equal to the height of said root element and a second length extending outwardly from said root element, said length of second plate means being less than said length of first plate means, a solid core means within said root element and fixedly gripped by the inner wall thereof, said core means having a height substantially equal to that of said root element, a packet of abrasive flaps of uniform size and shape gathered together along a common edge and overlapped with at least a portion of the length of said first plate means which extends beyond said second plate means, and means for fixing said packet to said first plate means.

6. The device of claim 5 wherein said fixing means comprises staple-like means passed through said packet and said first plate means.

7. A device for maintaining an abrasive packet within a slot and bore combination in a rotatable hub in fixed relation to the rotatable hub against centrigufal and tensile forces comprising a metallic member structured to fit snugly within the slot and bore combination in the hub including first means having a predetermined length and height, second means having a length less than the length of said first means, and height substantially equal to that of said first means, said second means extending substantially parallel to and in surface-to-surface abutment with said first means, third means integral with and joining said first and second means, said third means having a substantially circular configuration intermediate said first and second means and extending in a relationship having small angles between successive positions on the third means and between successive positions in the transition between the third means and the first means and between the third means and the second means, and fourth means disposed snugly within said third means along the predetermined height of the third means for preventing deformation of said third means and for controlling the bending of said member between said third means and said first and second means.

8. The device of claim 7 wherein said fourth means comprises solid core means located within said third means and wherein there are no sharp bends in the transition between the third means and the first means and between the third means and the second means.

9. The device of claim 8 wherein said core means includes a rod-like member fixedly gripped by the inner wall of said third means when said metalic member is formed to define said first, second, and third means.

10. The method of constructing a flexible drum segment comprising the steps of gathering a plurality of abrasive flaps together along a common edge thereof to form a packet, providing a core, bending a plate around the core to form a substantially flat, relatively large, first plate section, a substantially flat, relatively small, second plate section abutting and parallel to the first plate section and a generally circular root element joining the first and second plate sections and extending a relationship having small angles, with no sharp bends, between successive positions on the root element and between successive positions in the transition between the root element and each of the first and second plate sections and extending in a tight relationship with the core, the core being so sized and shaped as to substantially fill the interior of the root element in the finished flexible drum segment, overlapping the first plate section and the common edge of the packet, and fixing the packet to the overlapped portion of the first plate section.

11. The method set forth in claim 10 wherein the packet of abrasive flaps is stapled to the first plate section at a position where the first plate section has extended beyond the second plate section.

12. In a method of maintaining an abrasive packet in fixed relation to a rotatable hub against centrifugal and tensile forces generated by the packet during rotation of the hub, comprising the steps of providing a metal plate of predetermined height and length in accordance with the sizes of the hub and packet to be employed, providing a rod-like element having a predetermined diameter and a particular axis at the center of the rod and a length substantially equal to the length of the plate, bending the plate about the particular axis while locating the rod-like element on the axis, thereby forming a first plate section having a relatively long length and a second plate section having a shorter length than the first section and located in substantially parallel, surface-to-surface abutment with the first plate section and further forming between the first and second plate sections a root section abutting the rod along the length of the rod and defining small angles between successive positions on the root element and between successive positions in the transition between the root element and each of the first and second plate sections and thereby also causing the rod-like element to be gripped by the wall of the root section about the axis while limiting the bend angles occurring between the root section and the first and second plate sections.

13. The method set forth in claim 11 wherein a packet of abrasive leaves are attached to the first plate section at a position beyond the second plate section after the bending of the plate to define the first and second plate sections and the root section

14. The method set forth in claim 13 wherein the packet of abrasive leaves is stapled to the first plate section and inserting the root section and the rod into an opening in the periphery of the hub.

15. The method set forth in claim 14 wherein the second plate section is disposed substantially within the opening in the hub and the first plate section extends beyond the periphery of the hub and the packet of abrasive leaves is attached to the first plate section at a position beyond the periphery of the hub and the opening is provided at its inner end with an annular configuration having dimensions to receive the root section snugly within this annular configuration.

* * * * *